US005769629A

United States Patent [19]

Nakamura

[11] Patent Number: 5,769,629

[45] Date of Patent: Jun. 23, 1998

[54] SEALING APPARATUS FOR INLET/OUTLET OF ATMOSPHERE HEAT TREATMENT FURNACE

[75] Inventor: Teruhisa Nakamura, Shinnanyo, Japan

[73] Assignee: Nisshin Steel Co., Ltd., Tokyo, Japan

[21] Appl. No.: 592,345

[22] PCT Filed: Jun. 5, 1995

[86] PCT No.: PCT/JP95/01100

§ 371 Date: Feb. 7, 1996

§ 102(e) Date: Feb. 7, 1996

[87] PCT Pub. No.: WO95/33860

PCT Pub. Date: Dec. 14, 1995

[30] Foreign Application Priority Data

Jun. 7, 1994 [JP] Japan ..... 6-125549
Dec. 27, 1994 [JP] Japan ..... 6-326163

[51] Int. Cl.[6] ..... D06B 23/18

[52] U.S. Cl. ..... 432/242; 266/183; 34/242

[58] Field of Search ..... 432/53, 56, 64, 432/242, 244; 226/181, 183, 185, 186, 188, 191; 34/242, 406, 414, 417

[56] References Cited

U.S. PATENT DOCUMENTS 3,291,468 12/1966 Albertsen et al. .
4,190,966 3/1980 Sando et al. ..... 34/242

FOREIGN PATENT DOCUMENTS 42-18893 6/1967 Japan .
1529757 10/1978 United Kingdom ..... 432/242

OTHER PUBLICATIONS

New U.S. Patent Application filed Feb. 7, 1996 Corresponding to PCT/JP95/01101, filed Jun. 5, 1995, by Teruhisa Nakamura, entitled "Sealing Apparatus for Inlet/Outlet of Atmosphere Facility".
English Abstract of Japanese Patent, Publication No. 62287020A (Dec. 1987).
English Abstract of Japanese Patent, Publication No. 05214450A (Aug. 1993).
English Abstract of Japanese Patent, Publication No. 06346155A (Dec. 1994).

*Primary Examiner*—Henry A. Bennett
*Assistant Examiner*—Gregory Wilson
*Attorney, Agent, or Firm*—Wenderoth, Lind & Ponack

[57] ABSTRACT

A sealing apparatus securely seals the inlet and outlet of an atmosphere heat treatment furnace. A pair of elastic rolls 26 and a pair of additional elastic rolls 26 hold a metal strip so as to seal the inlet and outlet of the atmosphere heat treatment furnace which continuously performs bright annealing of the metal strip in a combustible atmosphere gas including hydrogen gas. A pair of intermediate rolls are disposed between the elastic rolls and the additional elastic rolls. The outer peripheral surface of the elastic roll is sealed by a seal plate. By multi-stage sealing, the outside air can be shut off securely from the atmosphere of the furnace.

21 Claims, 11 Drawing Sheets

SEALING APPARATUS FOR INLET/OUTLET OF ATMOSPHERE HEAT TREATMENT FURNACE

BACKGROUND OF THE INVENTION

1. Field of the Invention

The present invention relates to a sealing apparatus for sealing the inlet and/or the outlet of an atmosphere heat treatment furnace for continuously atmosphere-heat-treating strips, such as a bright annealing furnace for treating metal strips.

2. Description of the Related Art

Conventionally, as shown in FIG. 12, strips such as metal strips are treated continuously in an atmosphere facility. For example, a metal strip 1 is subjected to heat treatment for annealing in a nonoxidizing atmosphere in a vertical bright annealing furnace. The metal strip 1 and a bright annealing furnace 2 are grounded electrically by a grounding line 3. The direction of the metal strip 1 is changed by rolls 4 disposed at appropriate positions, and the metal strip 1 enters the bright annealing furnace 2 from a sealed portion 5 of an inlet of furnace 2 and is delivered from a sealed portion 6 of an outlet thereof.

The bright annealing furnace 2 continuously anneals the metal strip 1, such as stainless steel strips, other alloy steel strips, high-alloy strips, copper alloy strips and copper strips, while preventing oxidation. For this purpose, a combustible gas having the danger of causing explosions and fires, for example, a gas including hydrogen gas, such as ammonia decomposition gas or a mixture gas of hydrogen and nitrogen, is used as a furnace atmosphere gas 7. Therefore, the sealing performances at the sealed portions 5 and 6 of the inlet and outlet, respectively, are very important to ensure the quality of the products and the safety of operation. The above-mentioned grounding line 3 also functions as a part of safety measures.

A typical prior art of sealing apparatus for sealing an inlet or an outlet is disclosed, for example, in Japanese Examined Patent Publication JPB1 42-18893 (1967). In such prior art arrangement, the metal strip 1 is held between a pair of elastic rolls 8 at the sealed portions 5 and 6 of the inlet and the outlet, respectively. A seal plate 9 pushes the outer peripheral side surface of the elastic roll 8 to hermetically seal the boundary between the casing 10 of the bright annealing furnace 2 and each elastic roll 8.

In the sealing apparatus wherein the metal strip 1 is held between the elastic rolls 8 such as the above-mentioned prior art arrangement, when the metal strip 1 is thick as shown in FIG. 13, it is inevitable that clearances 1*a* and 1*b* are generated at the edges of the metal strip 1, thereby lowering the sealing performance. Furthermore, since the metal strip 1 having a certain thickness is held between the elastic rolls 8 during operation, the portions of the elastic rolls 8 contacting the sharp edges of the metal strip 1 are subjected to large cutting forces at all times and are apt to be dented or damaged due to friction. In the case where such dents are generated on the pair of elastic rolls 8, the clearances are increased, thereby further lowering the sealing performance. To solve this problem, the seal plate 9 comprising a nonwoven cloth 12, an elastic member 13 and a backup plate 14 pushes the outer peripheral side surface of the elastic rolls, as shown in FIG. 14.

The backup plate 14 is divided into a plurality of segments in the axial direction of the elastic roll 8 so that the nonwoven cloth 12 closely contacts the elastic roll 8 even when the elastic roll 8 is partially dented because of friction. Moreover, as shown in FIG. 15, as the passing speed of the metal strip 1 or the rotation speed of the elastic roll 8 increases, the oxygen in the outside air (oxygen $O_2$ in the air or oxygen in water vapor $H_2O$ in the air) is increasingly taken into the bright annealing furnace 2 because of the minute uneven portions on the surface of the metal strip 1 and the minute uneven portions on the surface of the elastic roll 8, thereby deteriorating the dew point of the atmosphere gas in the furnace, generating coloration (a serious defect caused during treatment in the bright annealing furnace) and significantly lowering the quality of products. Unless the concentration of the oxygen ($O_2$) in the furnace is about 50 ppm or less, the metal strip 1 is not of commercial quality. Since supplying a large amount of the atmosphere gas not only increases consumption of such expensive gas but also increases the risk of fires and explosions, the atmosphere gas cannot be supplied in large amounts. Therefore, preventing the outside air from being taken into the furnace has been a problem to be solved up to this time.

The object of the present invention is to provide a sealing apparatus for the inlet and/or outlet of an atmosphere heat treatment furnace, having capability of enhancing sealing performance, which might not be easily attained only by holding the strip between the pair of elastic rolls.

DISCLOSURE OF THE INVENTION

The invention provides a sealing apparatus for hermetically sealing the inlet and/or outlet of an atmosphere heat treatment furnace while holding a strip between a pair of elastic rolls, the sealing apparatus comprising:

a pair of additional elastic rolls for holding the strip outside the atmosphere heat treatment furnace, spaced from the pair of elastic rolls; and a pair of intermediate rolls disposed between the pair of elastic rolls and the pair of additional elastic trolls.

Furthermore, the atmosphere heat treatment furnace is filled with an atmospheric combustible gas including hydrogen gas retained under a pressure slightly higher than the atmospheric pressure.

The sealing apparatus is provided with supply means for supplying the atmosphere gas for the atmosphere heat treatment furnace or a gas similar to the atmosphere gas to a space surrounded by all the rolls.

The sealing apparatus is provided supply means for supplying an inert gas or a gas similar to an inert gas to a space surrounded by all the rolls.

The supply means is provided with an ion generator.

Furthermore, the invention provides a sealing apparatus for hermetically sealing the inlet and/or outlet of an atmosphere heat treatment furnace while holding a strip between a pair of elastic rolls, the sealing apparatus comprising:

a pair of additional elastic rolls for holding the strip outside the atmosphere heat treatment furnace, spaced from the pair of elastic rolls; and a pair of intermediate rolls disposed between the pair of elastic rolls and the pair of additional elastic rolls;

wherein the inside of the atmosphere heat treatment furnace is maintained under vacuum or reduced pressure.

Suction means for conducting vacuum suction of a space surrounded by the rolls is provided.

Furthermore, plural pairs of intermediate rolls and plural pairs of additional elastic rolls are provided so as to be arranged along the strip treated or to be treated.

The sealing apparatus of the invention comprises:

a side wall for sealing by contacting with the respective end surfaces of the plural rolls;

a seal plate for sealing the boundary between a casing and each of the pair of elastic rolls disposed most adjacently to the atmosphere heat treatment furnace by elastically contacting with the outer peripheral surfaces of the pair of elastic rolls;

covering members formed of an elastic material, comprising a first flange contacting the end surfaces of the rolls and a first sleeve extending outwardly from the outer peripheral surface of the first flange in the axial direction of the rolls, the covering members being incorporated as members of a roll end seal apparatus and disposed on both ends of each roll;

first supporting members disposed on both ends of each roll and formed of a rigid material, each first supporting member comprising a second flange which makes a junction with the outer surface of the first flange, and a second sleeve extending outwardly from the outer peripheral surface of the second flange in the axial direction of the rolls;

second supporting members disposed on both ends of each roll and formed of a rigid material, each second supporting member comprising a third sleeve arranged between the shaft of each roll and the second sleeve outwardly from the second flange in the axial direction of the rolls and a third flange extending from the outer end surface of the third sleeve in the axial direction of the roll to the radial direction of the rolls;

outer bearings each interposed between the third sleeve and the second sleeve, which receive radial and thrust forces, the outer bearing being disposed on both ends of each roll;

inner bearings each interposed between the third sleeve and the shaft of each roll; and an end surface sealing member interposed between the side wall of the casing and the third flange of the second supporting member at both ends of each roll, at least the outward side of which in the radial direction of the roll is formed of an elastic material.

Furthermore, the sealing apparatus of the invention is provided with means for injecting an inert gas or a gas similar to the atmosphere gas of the furnace into spaces formed inwardly from the portions where the third flanges of the second supporting members, connected to the side wall surface via the end surface sealing member, slidingly contacts the covering members rotating together with the rolls during rotation, via gas passages provided in the shafts of the rolls.

Furthermore, the sealing apparatus of the invention is provided with means for conducting vacuum suction of spaces formed inwardly from the portions where the third flanges of the second supporting members, connected to the side wall surface via the end surface sealing member, slidingly contacts the covering members rotating together with the rolls during rotation, via gas passages provided in the shafts of the rolls.

According to the invention, a strip is held between the pair of elastic rolls and the pair of additional elastic rolls. A pair of intermediate rolls is provided between the pair of elastic rolls and the pair of additional elastic rolls. Since the intermediate rolls intervene, the pair of elastic rolls and the pair of additional elastic rolls rotate in the same direction, whereby sealing is made possible while allowing the metal strip to pass therethrough. Since the sealing by the elastic rolls is performed at two positions, more reliable sealing than that at one position is realized.

Furthermore, according to the invention, the atmosphere heat treatment furnace is filled with a combustible atmosphere gas including hydrogen gas retained under a pressure slightly higher than the atmospheric pressure. In the case where this kind of combustible atmosphere gas leaks into the outside air, ignition is apt to occur. The danger of causing explosions and fires can be prevented by enhancing the performance of sealing the inlet and outlet.

Furthermore, according to the invention, the atmosphere gas of the atmosphere heat treatment furnace or a gas similar to the atmosphere gas is supplied to a space formed by being surrounded by the pair of elastic rolls, the pair of intermediate rolls and the pair of additional elastic rolls. The entry of oxygen or the like from the outside air into the atmosphere heat treatment furnace via the space can be prevented easily by raising the pressure of the supply gas.

Furthermore, according to the invention, an inert gas or a gas similar to the inert gas is supplied to the space formed by being surrounded by the rolls. The entry of oxygen from the outside air into the atmosphere heat treatment furnace via the space can be reduced by raising the pressure of the inert gas or the like.

Furthermore, according to the invention, since means for supplying the atmosphere gas of the atmosphere heat treatment furnace or a gas similar to the atmosphere, or an inert gas or a gas similar to the inert gas to the space formed by being surrounded by the rolls is provided with an ion generator, the supply gas can include ions. Therefore, even when electrostatic charge occurs on the elastic rolls, sparking or the like can be prevented by neutralization of such charge.

Furthermore, according to the invention, in order to maintain the atmosphere of the atmosphere heat treatment furnace under vacuum or reduced pressure under a pressure lower than atmospheric pressure, the elastic rolls and additional elastic rolls are arranged along the strip to conduct sealing at two positions, whereby the inlet/outlet is reliably sealed.

Furthermore, according to the invention, the space formed by being surrounded by the rolls is subjected to vacuum suction by suction means. When the atmosphere heat treatment furnace, such as a vacuum evaporation furnace, requires an atmosphere maintained under vacuum or reduced pressure, the outside air can be prevented further reliably from entering the furnace.

Furthermore, according to the invention, the multi-stage hermetic sealing wherein plural pairs of intermediate rolls and additional elastic rolls provided along the strip are used can further enhance the sealing performance.

Furthermore, according to the invention, the boundary between the end surface of each elastic roll and the side wall is securely sealed by the covering member and the end surface sealing member, which are formed of elastic materials and assembled as members constituting a roll end surface sealing device. In addition, the first supporting member and the second supporting member formed of rigid materials, and the outer and inner bearings can reduce rotation loads.

Furthermore, according to the invention, since the space formed inwardly from the portion where the third flange of the second supporting member contacting the side wall surface via the end surface sealing member makes contact with the covering member rotating together with the roll while rotating and sliding can be filled with an inert gas, the atmosphere gas in the furnace can be securely prevented from leaking into the outside air, for example, by raising the pressure of the inert gas so as to be higher than the atmosphere of the atmosphere heat treatment furnace.

Furthermore, according to the invention, since a space formed inwardly from the portion where the third flange of the second supporting member contacting the side wall surface via the end surface sealing member slidingly contacts with the covering member rotating together with the roll during rotation is subjected to vacuum suction, the outside air can be securely prevented from entering into the furnace, in particular when the atmosphere heat treatment furnace is operated under a pressure lower than the pressure of the outside air.

DETAILED DESCRIPTION OF THE INVENTION

Figure 1:
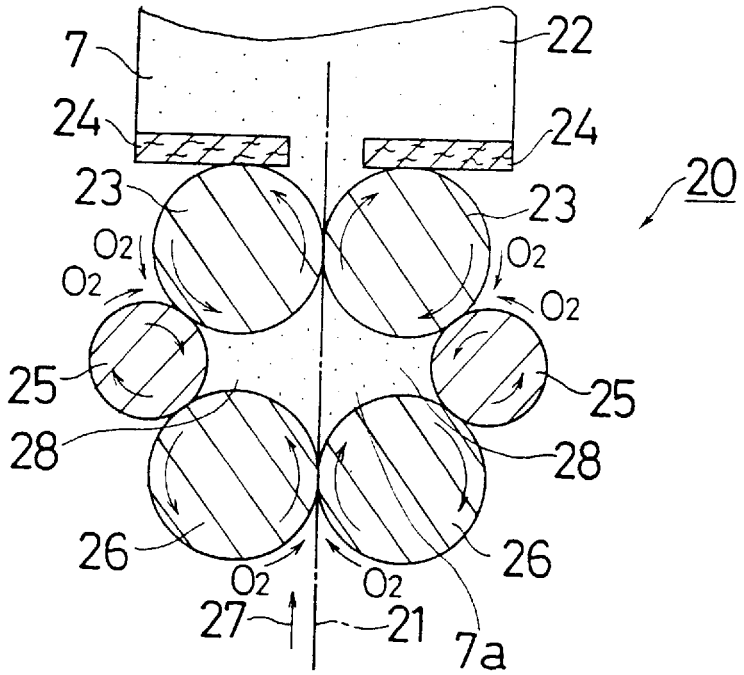
FIG. 1 is a schematic front sectional view showing a basic structure of a first embodiment of the present invention.
Figure 2:
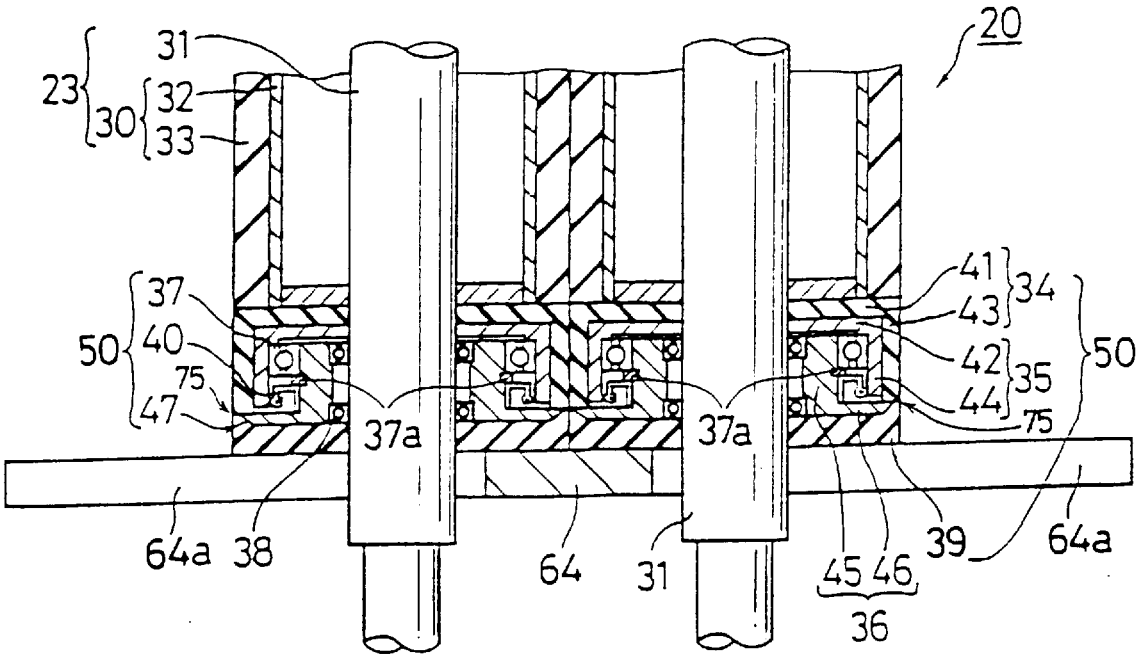
FIG. 2 is a partial sectional view showing the structure of an end surface seal of the embodiment of FIG. 1.
Figure 3:
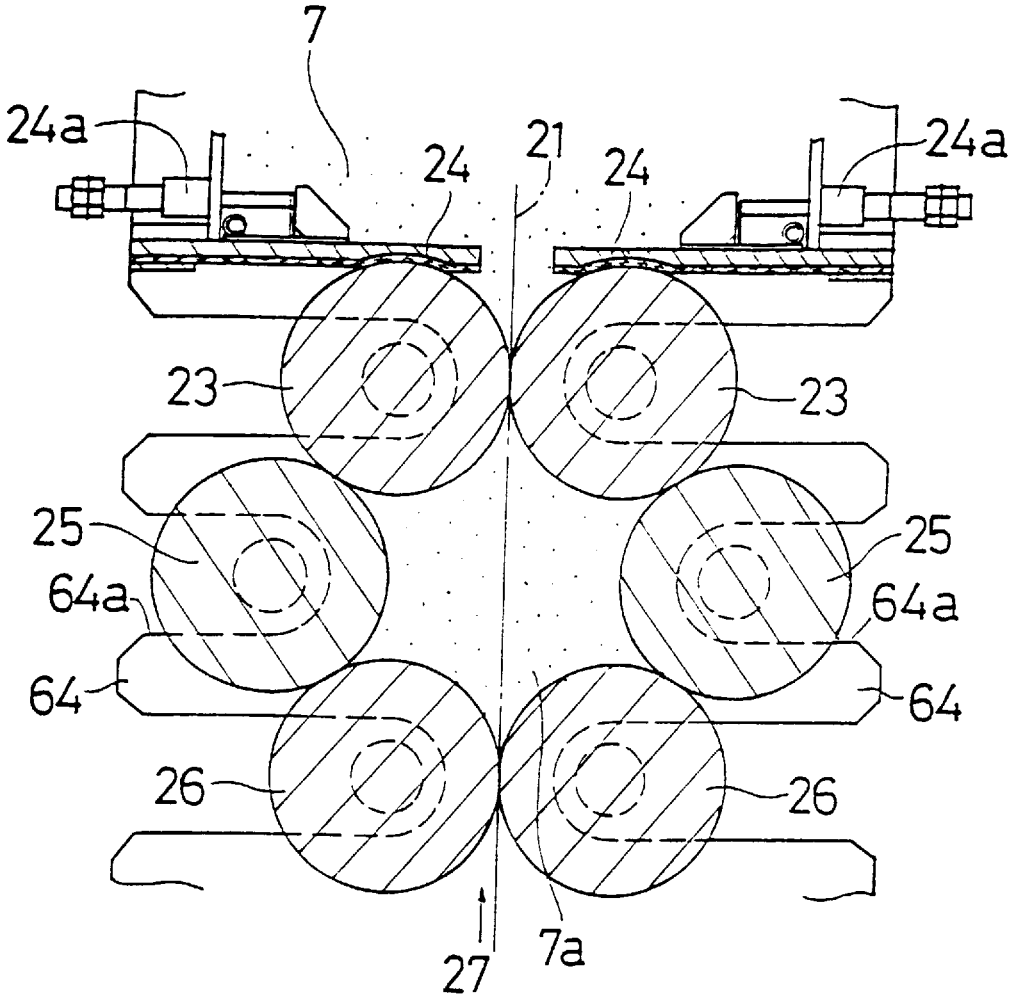
FIG. 3 is a schematic front sectional view showing the arrangement of rolls in the first embodiment.
Figure 4:
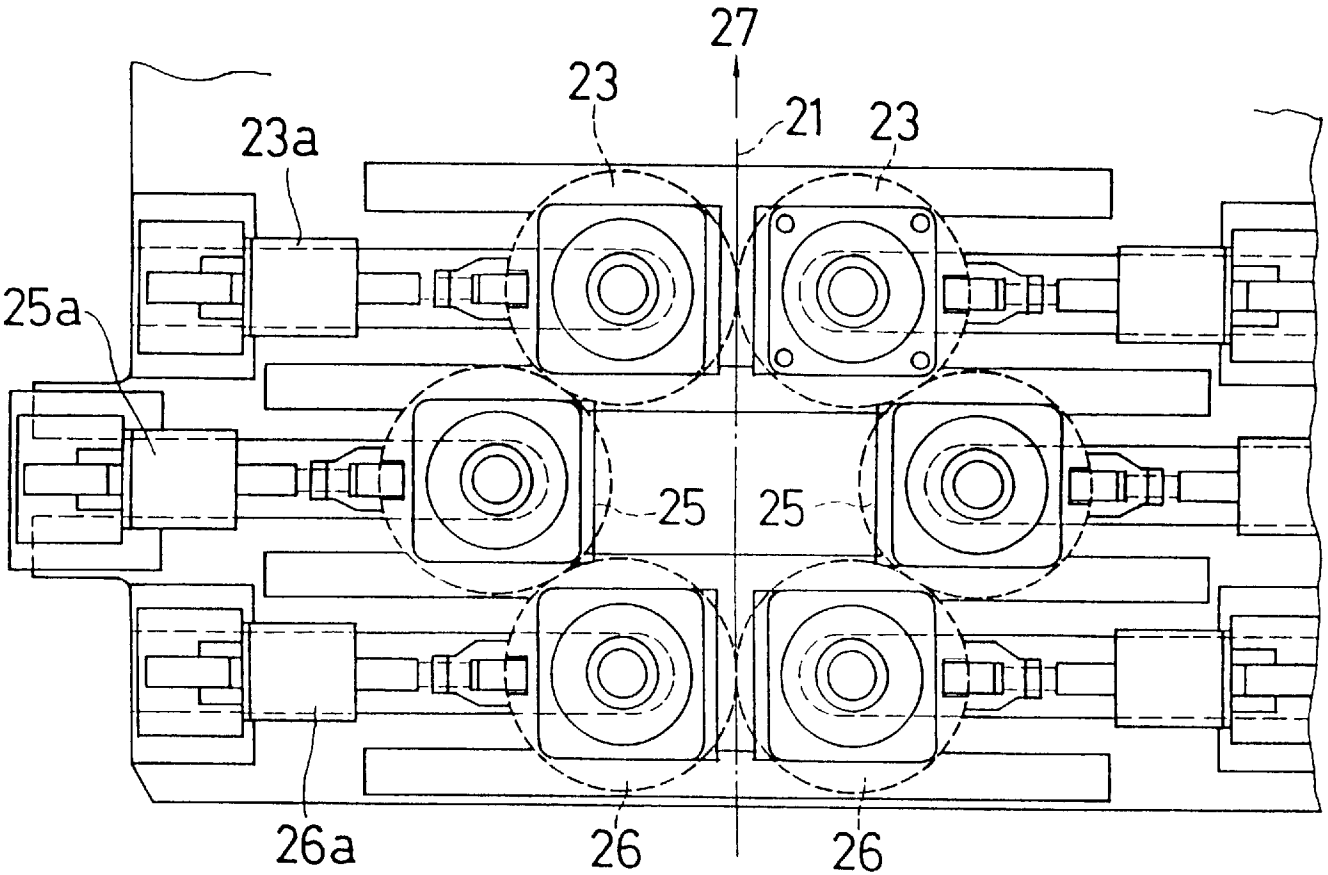
FIG. 4 is a front view showing a movement mechanism for the rolls in the first embodiment.
Figure 5:
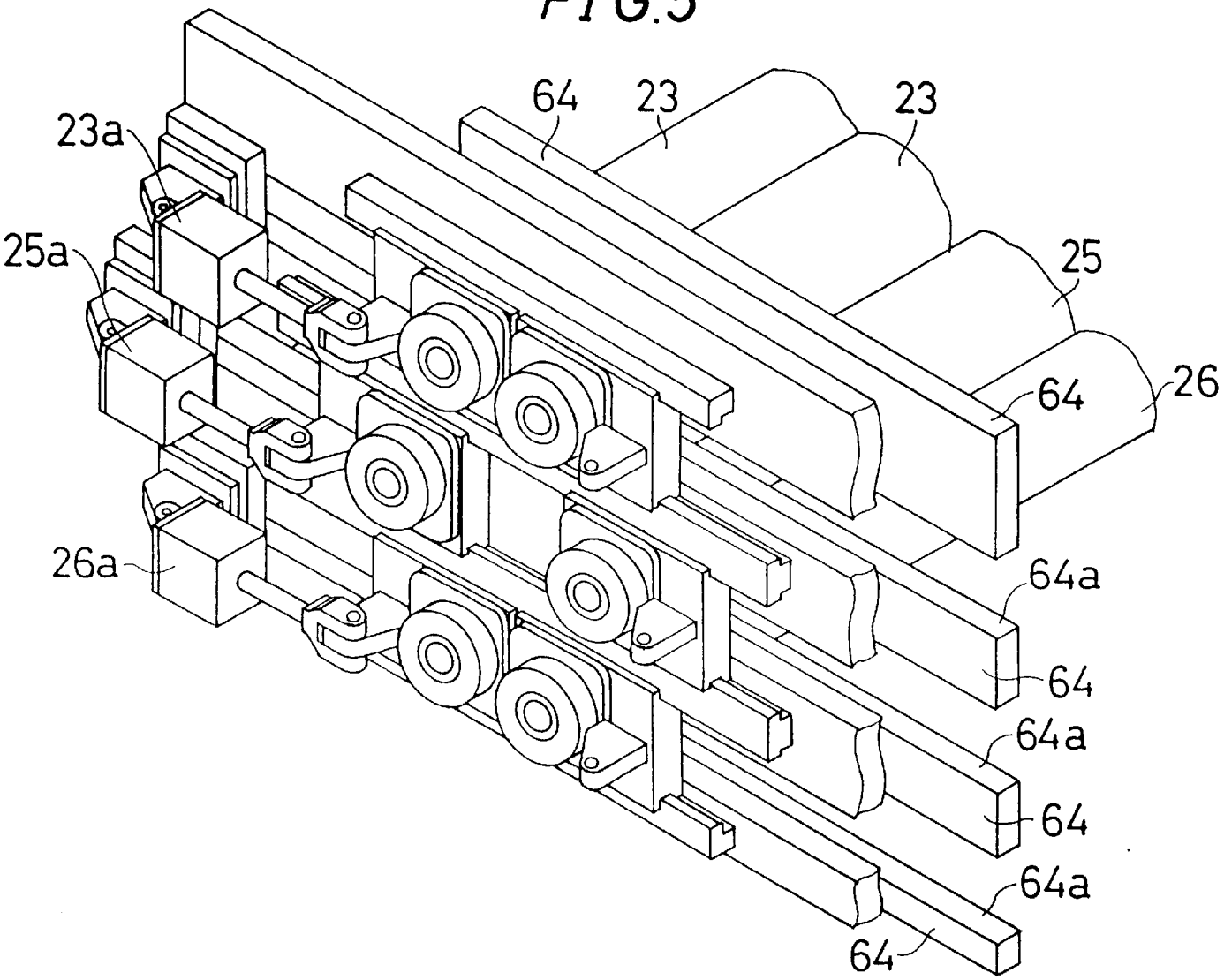
FIG. 5 is a perspective view showing the movement mechanism for the rolls in the first embodiment.
Figure 6:
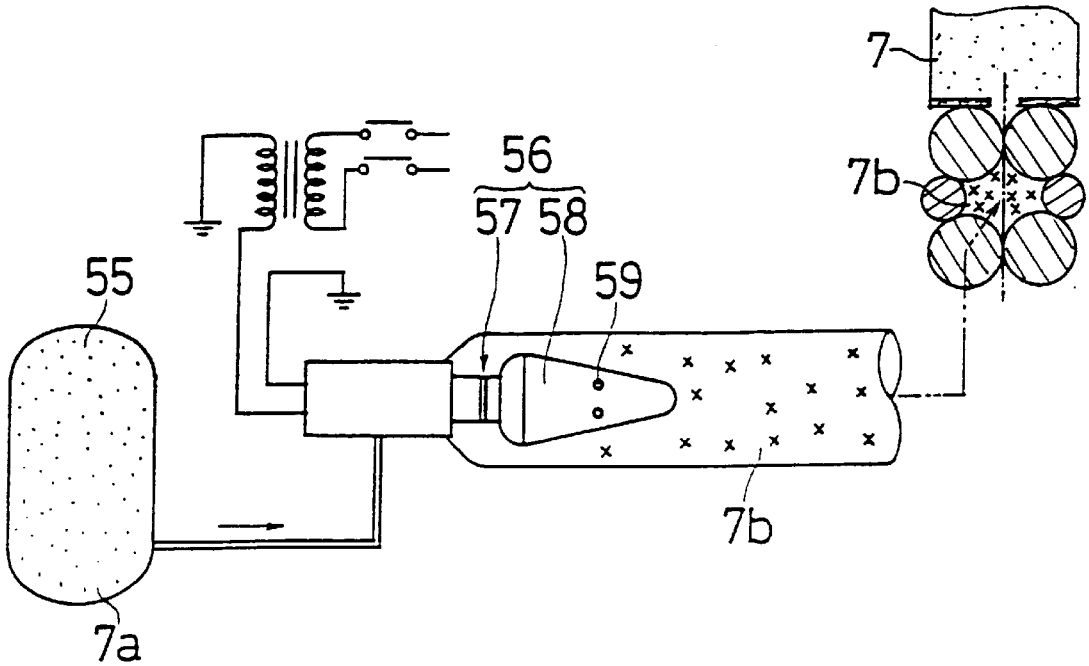
FIG. 6 is a piping system diagram for atmosphere adjustment in the first embodiment.
Figure 7:
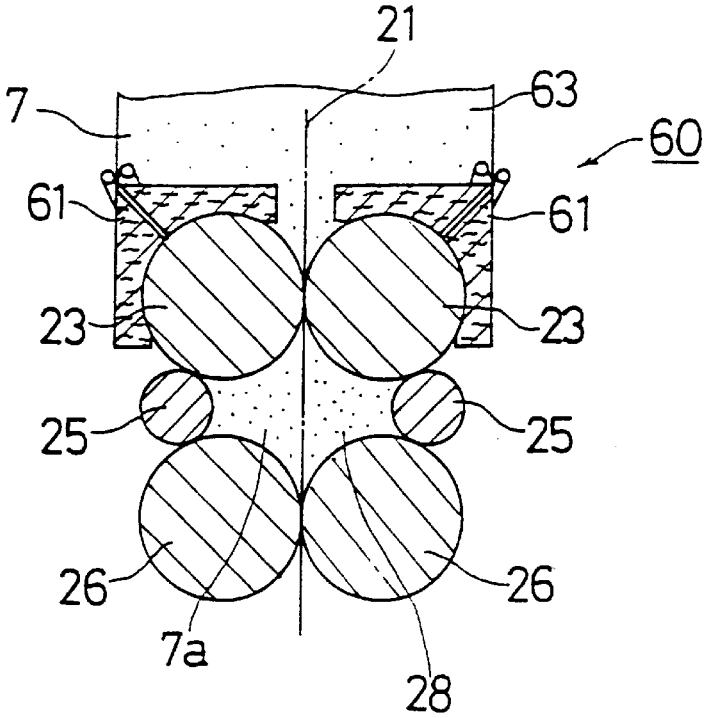
FIG. 7 is a schematic front sectional view showing a basic structure of a second embodiment.
Figure 8:
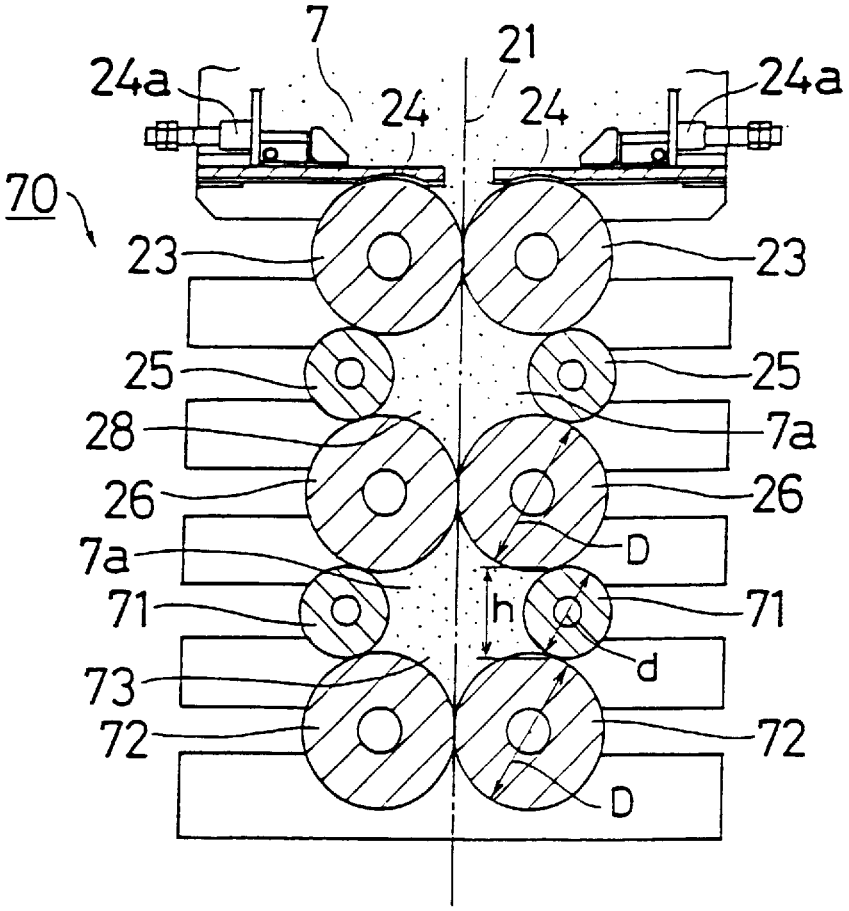
FIG. 8 is a front sectional view showing a structure of a third embodiment.
Figure 9:
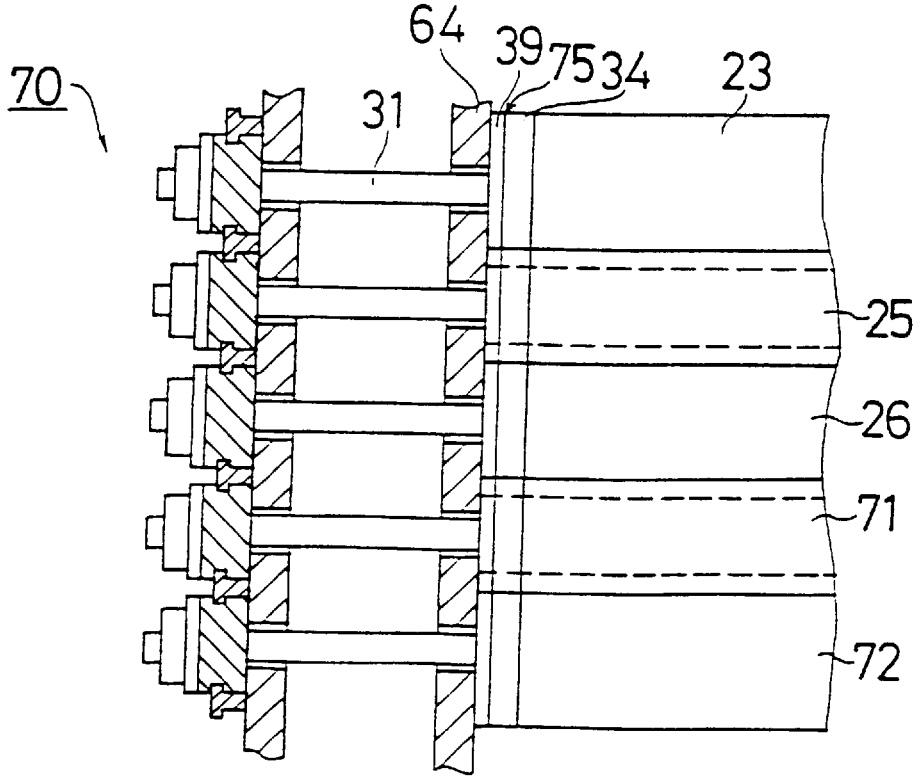
FIG. 9 is a side sectional view of the third embodiment.

Embodiments of the present invention are described below referring to FIGS. 1 to 9. FIG. 1 shows a structure of a first embodiment of the invention; FIG. 2 shows a structure for sealing an end of an elastic roll; FIG. 3 shows the arrangement of rolls; FIGS. 4 and 5 show a movement mechanism for the rolls; FIG. 6 shows a piping system for adjusting an atmosphere in the space surrounded by the rolls; FIG. 7 shows a basic structure of a second embodiment; FIGS. 8 and 9 show a structure of a third embodiment. The same reference numerals designate the same parts corresponding to each embodiment.

As shown in FIG. 1, in a sealing apparatus 20, a pair of elastic rolls 23 disposed closely to the inlet or outlet of a bright annealing furnace (atmosphere heat treatment furnace) 22 hold a metal strip 21 so that the metal strip 21 is fed to or delivered from the bright annealing furnace 22, and the outer peripheral portions of the elastic rolls 23 are sealed by seal plates 24. Outwardly, from the bright annealing furnace 22 and along the metal strip 21 from the elastic rolls 23, a pair of additional elastic rolls 26 are provided via a pair of intermediate rolls 25. The additional elastic rolls 26 also hold both sides of the metal strip 21 in the thickness direction thereof to attain sealing. At the sealed portion of the inlet through which the metal strip 21 enters the bright annealing furnace 22 in the passing direction indicated by an arrow 27, air including oxygen ($O_2$), water vapor ($H_2O$) and the like are apt to be taken from the outside air by the uneven surfaces of the metal strip 21 and the uneven surfaces of the additional elastic rolls 26 into the bright annealing furnace 22. Furthermore, the outside air is also apt to enter from the boundaries between the elastic rolls 23 and the intermediate rolls 25.

On the other hand, the atmosphere gas in the bright annealing furnace 22 generally leaks slightly into the space 28 surrounded by the rolls. The atmosphere gas, which includes hydrogen gas, is combustible. In particular, at the sealing apparatus 20 on the outlet side of the bright annealing furnace 22, the atmosphere gas attaches to the minutely uneven surfaces of the elastic rolls 23 and to the surfaces of the traveling metal strip 21 and is taken from the bright annealing furnace 22 and is apt to leak into the intermediate space 28. In the same way, at the sealing apparatus 20 on the inlet side of the bright annealing furnace 22, the outside air attached to the minutely uneven surfaces of the elastic rolls 23 and to the surfaces of the metal strip 21 is taken in the bright annealing furnace 22 and is apt to enter the intermediate space 28. In the case where oxygen enters the bright annealing furnace 22, the metal strip 21 is deteriorated because of discoloration and there is a danger of causing fires and explosions. To solve this problem, the pressure of the atmosphere gas is made slightly higher than the atmospheric pressure by about 50 $mmH_2O$, for example, so that the leakage of the atmosphere gas is more likely to occur than the entry of oxygen and the like (oxygen, nitrogen, water vapor and other gasses in the air). In the case of atmosphere gas leakage from the space 28, the gas is apt to leak, for example, from the boundaries between the elastic rolls 23 and the intermediate rolls 25, the boundaries between the intermediate rolls 25 and the additional elastic rolls 26 and the boundary between the additional elastic rolls 26 holding the metal strip 21. However, since the metal strip 21 is first held between the pair of additional rolls 26 and further is held by the pair of elastic rolls 23, the sealing performance of the sealing apparatus is higher than that of the prior art wherein only a pair of elastic rolls are used to hold the metal strip. When nitrogen gas ($N_2$), an inert gas or a gas 7*a* similar to the atmosphere is supplied to the space 28, the shut-off of the interior of the bright annealing furnace 22 from the outside air can be enhanced further.

FIG. 2 shows the structure of a roll end surface sealing device 50 for sealing the ends of the elastic rolls 23. The structure is similar to that used for the additional elastic rolls 26 and the intermediate rolls 25. Roughly speaking, the elastic roll 23 comprises a roll body portion 30 and a shaft 31. The roll body portion 30 comprises a main roll body 32 made of a rigid material, such as metal, and an elastic covering 33 disposed on the outer peripheral surface of the main roll body 32.

Outwardly from the roll body portion 30 in the axial direction thereof, a covering member 34, a first supporting member 35, a second supporting member 36, an outer bearing 37, a retaining ring 37*a*, inner bearings 38, an end surface sealing member 39, and a lip seal 40 are disposed between the end of the roll and a casing side wall 64. Like the elastic covering 33, the covering member 34 and the end surface sealing member 39 are made of a rubber material selected from among silicone rubber, fluororubber, urethane rubber, butyl rubber, isoprene rubber, nitrile rubber, polysulfide rubber, chlorosulfonic polyethylene, chlorinated polyethylene, acrylic rubber, hydrin rubber, EPDM, SBR, NBR and CR, having a hardness of 40° to 90° specified in JIS K 6301 A and mixed with carbon black or the like so as to enhance mechanical characteristics and to attain electrical conductivity. A cutout 64*a* provided on the casing side wall surface, through which the shaft 31 is passed, is sealed by the end surface sealing member 39. The first supporting member 35 and the second supporting member 36 are made of rigid materials.

A first inward flange 42 of the covering member 34 and a second inward flange 41 of the first supporting member 35 contact the end surface of the elastic roll 23 in this order. On the outer peripheral side of the first inward flange 41 of the covering member 34, first sleeve 43 of the covering member 34 is formed so as to extend outwardly in the axial direction of the elastic roll 23. Second sleeve 44 of the first supporting member 35 is formed so as to extend outwardly in the axial direction of the elastic roll 23 from the outer periphery of the second inward flange 42. The outer peripheral surface of the second sleeve 44 contacts the inner peripheral surface of the first sleeve 43, and the length of the second sleeve 44 is slightly shorter than that of the first sleeve 43 so as to prevent the second sleeve 44 from making metal to metal contact with third outward flange 46 of the second supporting member 36. A third sleeve 45 of the second supporting member 36 is disposed between the second sleeve 44 and the shaft 31. On the inward side of the elastic roll 23 in the axial direction thereof, a space is provided between the end surface of the third sleeve 45 and the outer surface of the second inward flange 42. Third outward flange 46 extends outwardly in the radial direction thereof from the outward end of the third sleeve 45 in the axial direction of the elastic roll 23. The outer peripheral portion of the third outward flange 46 is formed as a tapered surface 47, the diameter of which decreases outwardly in the axial direction of the flange 46. In the outside of the tapered surface 47 in the radial direction, a slight clearance 75 is present between the end surface of the first sleeve 43 and the outer periphery of the third outward flange 46. The expressions "inward" and "outward" used to describe the first, second and third flanges designate inward and outward with respect to the axial direction. However, the orientation of the flanges can be set either inward or outward.

Although the metal strip 21 appears to travel in a straight path, actually it slightly snakes repeatedly. Therefore, the elastic roll 23 holding the metal strip 21 always receives thrust force in the axial direction of the roll due to repulsion force caused by the snaking of the metal strip 21. The thrust force is transmitted to the third sleeve 45 of the second supporting member 36 by the second inward flange 42 of the first supporting member 35 and the outer bearing 37 via the retaining ring 37*a* or a stepped portion (not shown) of the third sleeve 45. In other words, the positional relationship between the first supporting member 35 and the second supporting member 36 is determined by the outer bearing 37. No matter how the thrust force is changed, constant force (such as elastic repulsion force exerted at the end of the covering member 34) is applied to the portion where the end surface of the first sleeve 43 of the covering member 34 contacts the axially inward outer peripheral portion of the third outward flange 46 while rotating and sliding. The rotating and sliding contact portion is not affected by the thrust force generated by the snaking of the metal strip 21 or the thermal expansion of the elastic roll 23. Accordingly, stable sealing performance can be attained at the rotating and sliding contact portion at all times. This matter also applies to the additional elastic rolls 26 and the intermediate rolls 25 in the same way.

The outer diameter of the elastic covering 33 is basically identical to that of the covering member 34. The maximum diameter of the third outward flange 46 is made smaller by $\Delta D$ than the outer diameter of the elastic covering 33. When the maximum thickness of the metal strip 21 held by the elastic rolls 23 and the additional elastic rolls 26 is t, the relationship between $\Delta D$ and t is represented by $\Delta D \leqq t$. Namely, when the metal strip 21 is held between the elastic rolls 23 disposed to face each other, the third outward flanges 46 disposed to face each other come into contact with each other. As a result, since the elastic rolls 23 are prevented from pushing the metal strip 21 and a clearance is formed between the elastic rolls 23 disposed to face each other, the sealing performance of sealing the atmosphere gas is lowered. To prevent this problem, the above relationship must be established. The smaller the value, the better. However, it is necessary to consider the deflection allowance of the shafts 31 when the metal strip 21 is held between the elastic rolls 23, it is also necessary to consider the deformation allowance of the elastic covering 33 of the elastic roll 23, the covering member 34 and the end surface sealing member 39 when their outer peripheries are pushed to attain sealing. This also applies to the additional elastic rolls 26 and the intermediate rolls 25 in the same way.

FIG. 3 shows the arrangement of the elastic rolls 23, the intermediate rolls 25 and the additional elastic rolls 26 in the embodiment of FIG. 1. The seal plate 24 is pushed against the outer peripheral portion of the elastic roll 23 by a pushing device 24*a*. The seal plate 24 has a concave arc shape matching the outer peripheral portion of the elastic roll 23.

FIG. 4 is a front view showing a structure for moving the rolls shown in FIG. 3, and FIG. 5 is a perspective view showing the structure for moving the rolls shown in FIG. 3. The rolls 23, 25, 26 are pushed by pairs of cylinders 23*a*, 25*a*, 26*a*, each pair being disposed to face each other, so as to push both sides of the metal strip 21 in the direction of the thickness thereof. However, in FIG. 5 the cylinders 23*a*, 25*a*, 26*a* on one side are not shown. At the time of maintenance, the rolls can be taken out perpendicularly to the metal strip passing direction 27 on both sides of the metal strip 21.

FIG. 6 shows a structure for attaining an atmosphere of an inert gas, nitrogen gas or a gas similar to the atmosphere of the furnace (these are hereinafter generally referred to as "inert gas") for the space 28 in the embodiment shown in FIG. 1. The gas in an inert gas tank 55 is supplied to the space 28 via an ion generator 56 such as "AIRMIZER" sold by Shinko. The inert gas supplied to the ion generator 56 flows from a slit 57 along the outer peripheral surface of a head 58 and is ionized by electrodes 59 disposed on the outer peripheral surface of the head 58. When an ionized inert gas 7*b* is supplied to the space 28, static electricity generated by compressive deformation, separation, surface friction or the like caused with rotation of the elastic materials on the surfaces of the elastic rolls 23 and the additional elastic rolls 26 is neutralized so as to prevent sparking or the like. Therefore, even when an atmosphere gas including hydrogen or the like and having such risk of causing explosions and fires flows out from the bright annealing furnace 22, the danger can be prevented. It is preferable that the elastic materials of the surfaces of the elastic roll 23 and the additional elastic roll 26, and the material of the seal plate 24 or the like are provided with a certain conductivity (a preferable range of 1 to $10^{7\ \Omega\cdot cm}$; $10^7$ Ω·cm or more may be allowed when an ion generator is used) so as to reduce the generation of static electricity. When the ion generator 56 is not used, it is preferable that the rolls have a specific electric resistance in the range of 1 to $10^6$ Ω·cm, and the seal plate have a value in the range of $10^{-3}$ to $10^6$ Ω·cm so as to prevent electrostatic charge.

FIG. 7 is a schematic view of the structure of a sealing apparatus 60 of the second embodiment of the invention. In this embodiment, a seal plate 61 is formed to match the shape of the outer peripheral surface of the elastic roll 23 so as to perform sealing along as long a peripheral length as possible to obtain a labyrinth effect. The seal plate 61 has a divided structure so that the roll can be replaced easily. The space 28 formed by being surrounded by the rolls is subjected to vacuum suction so that the space is particularly suited as a portion to be sealed of the inlet or outlet of an atmosphere heat treatment furnace such as a vacuum evaporation furnace 63, the atmosphere of which is maintained under vacuum or reduced pressure.

FIGS. 8 and 9 show a structure of the third embodiment of the invention. A sealing apparatus 70 of this embodiment is further provided with intermediate rolls 71 and additional elastic rolls 72 so as to define a space 73, thereby forming multiple spaces formed by being surrounded by rolls to attain more reliable sealing.

In all the embodiments, it is preferable that a first equation described below is established among diameter D of the elastic rolls 23 and the additional elastic rolls 26 and 72, distance h between the surfaces of these rolls and diameter d of the intermediate rolls 25 and 71.

$$D \geqq d > h \tag{1}$$

With this structure, the utilization factor of space can be increased and the sizes are also adjustable in a certain range. If d>D in particular, a wide area is required and the use of such a wide area is uneconomical. Although a metal strip is discussed above as a strip being sealed, a synthetic resin strip or the like to be painted can also be used. The invention can preferably be applied to an apparatus for painting synthetic resin or metal strips in a reduced pressure state or an apparatus for degreasing synthetic resin or metal strips by reduced pressure, heating and cooling. Furthermore, although a vertical furnace is used in each embodiment, a horizontal furnace can also be disclosed in the same way.

Figure 10:
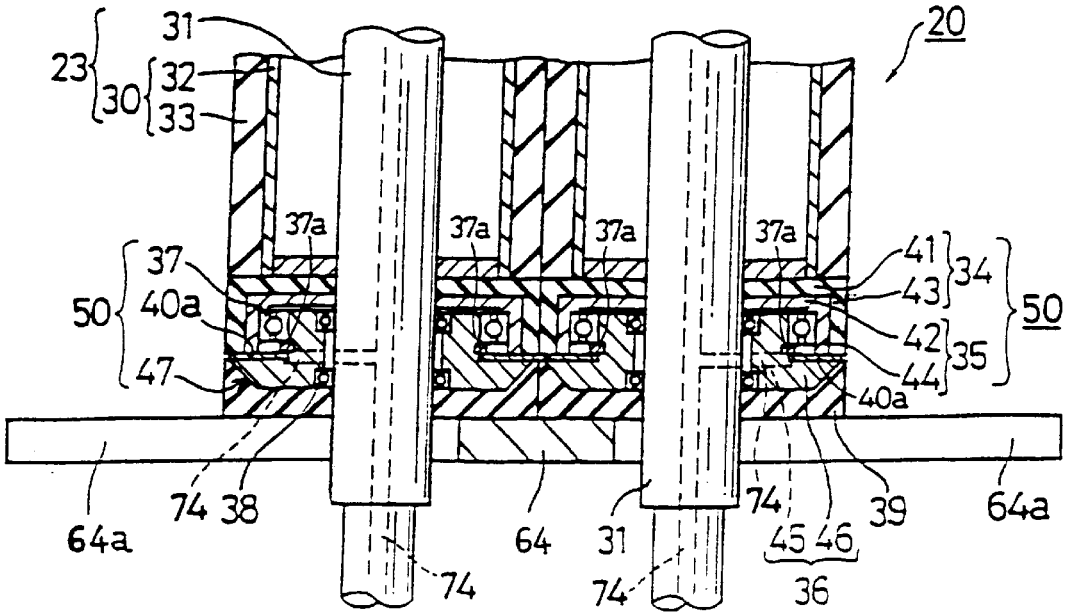
FIG. 10 is a partial sectional view showing the structure of an end surface seal of a fourth embodiment.

FIG. 10 shows the structure in accordance with the fourth embodiment of the invention. The same numerals designate the corresponding parts as in the first embodiment. Outward from the roll body portion 30 in the axial direction thereof, a covering member 34, a first supporting member 35, a second supporting member 36, an outer bearing 37, a retaining ring 37*a*, inner bearings 38, an end surface sealing member 39, and additionally a seal disc 40*a* instead of a lip seal 40 are disposed between the end of the roll and a side wall 64. Like the elastic covering 33, the covering member 34 and the end surface sealing member 39 are made of an elastic material selected from among silicone rubber, fluororubber, urethane rubber, EPDM, SBER, NBR, CR and the like, having a hardness of 40° to 90° specified in JIS K 6301 A and mixed with carbon black or the like so as to enhance mechanical characteristics and attain conductivity corresponding to a specific electric resistance in the range of 1 to $10^7$ Ω·cm to prevent electrostatic charge. When the elastic material has a specific electric resistance of more than $10^7$ Ω·cm, the elastic material is substantially the same as an insulator. This is improper. When the elastic material has a specific electric resistance of less than 1 Ω·cm, sparking may occur from a charged body such as a human body having approached the facility to make an inspection. Additionally, natural rubber, isoprene rubber, butyl rubber, polysulfide rubber, acrylic rubber, hydrin rubber, chlorosulfonic polyethylene, chlorinated polyethylene and the like can also be used as an elastic material. The first supporting member 35 and the second supporting member 36 are made of rigid materials such as metal.

The first inward flange 41 of the covering member 34 and the second inward flange 42 of the first supporting member 35 contact the end surface of the elastic roll 23 in this order. On the outer peripheral side of the first inward flange 41 of the covering member 34, the first sleeve 43 of the covering member 34 is formed so as to extend outwardly in the axial direction of the elastic roll 23. The second sleeve 44 of the first supporting member 35 is formed so as to extend outwardly in the axial direction of the elastic roll 23 from the outer periphery of the second inward flange 42. The outer peripheral surface of the second sleeve 44 contacts the inner peripheral surface of the first sleeve 43, and the length of the second sleeve 44 is slightly shorter than that of the first sleeve 43 so as to prevent the second sleeve 44 from making metal contact with the third outward flange 46 of the second supporting member 36. Between the second sleeve 44 and the flange 46, the seal disc 40*a* having a thickness of about 1 to 2 mm and made of Teflon (PTFE) or mainly composed of Teflon is disposed. One disc or two seal discs 40*a* (not shown) may be used. When two pieces of the seal discs 40*a* are used, an electrostatic charge may occur due to slippage between the two seal discs 40*a*. To prevent this problem, it is preferable that the specific electric resistance is in the range of 1 to $10^7$ Ω·cm because of the reason described relative to the covering 34. The third sleeve 45 of the second supporting member 36 is disposed between the second sleeve 44 and the shaft 31. On the inward side of the elastic roll 23 in the axial direction thereof, a space is provided between the end surface of the third sleeve 45 and the outer surface of the second inward flange 42. The third outward flange 46 extends outwardly in the radial direction thereof from the outward end of the third sleeve 45 in the axial direction of the elastic roll 23.

The outer peripheral portion of the third outward flange 46 is formed as a tapered surface 47, the diameter of which decreases outwardly in the axial direction of the flange 46. The axially outer side of the third outward flange 46 is pushed against the side wall 26 of the casing via the end surface sealing member 39 and the third outward flange 46 is thus secured. At the axially inward outer peripheral portion of the third outward flange 46, the end surface of the first sleeve 43 of the covering member 34 pushes the seal disc 40*a* only by using the elastic repulsion force generated at the end of the covering 34 instead of the thrust force of the roll, and the seal disc 40*a* contacts the third outward flange 46 while rotating and sliding so as to seal the space formed inwardly from the contact portion. Furthermore, a vent hole 74 used as a gas flow line is formed in the roll shaft 31, and one or several vent holes 74 are disposed from the inside to the outside of the third sleeve 45. With this structure, the atmosphere in the sealed space can be adjusted by externally increasing or decreasing the pressure. The outer diameter of the elastic covering 33 is basically identical to that of the covering member 34. The maximum diameter of the third outward flange 46 and the seal disc 40*a* are made smaller by ΔD than the outer diameter of the elastic covering 33. When the maximum thickness of the metal strip 21 held between the elastic rolls 23 is t, the relationship between ΔD and t is represented by $\Delta D \leqq t$. In case this relationship is not established, when the elastic rolls 23 disposed to face each other hold the metal strip 21, the third outward flanges 46 and the seal discs 40*a* disposed to face each other come into contact with each other. As a result, the elastic rolls 23 are prevented from pushing the metal strip 21, a clearance is formed between the elastic rolls 23 disposed to face each other, and the sealing performance of the atmospheric is lowered. To prevent this problem, the above relationship must be established.

This can also be applied to the additional elastic rolls 26, 72. It is preferable that relationship $\Delta D \leqq t$ or a similar relationship is established for the intermediate rolls 25, 71, since the deformation allowance or the like for the elastic covering 33 must be considered. Although the value should be as small as possible, the deflection allowance for the shaft 31 must be considered since the shaft is deflected when the rolls hold the metal strip 21, and the deformation allowance for the outer peripheries of the covering member 34 and the end surface sealing member 39 of the roll end sealing device 50 must also be considered since the outer peripheries are pushed and deformed to attain sealing.

Figure 11:
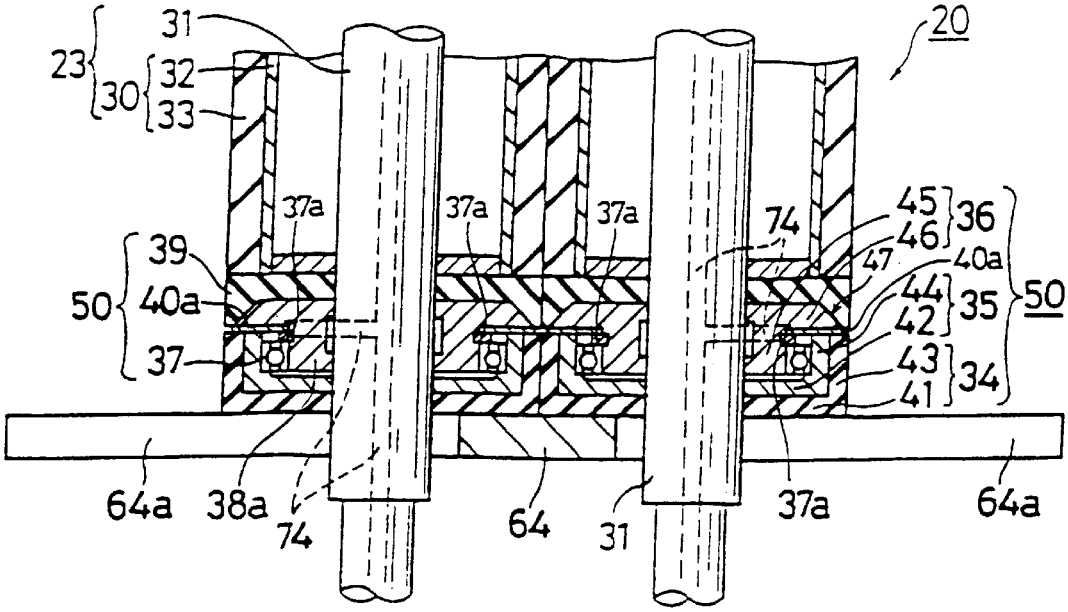
FIG. 11 is a partial sectional view showing the structure of an end surface seal of a fifth embodiment.
Figure 12:
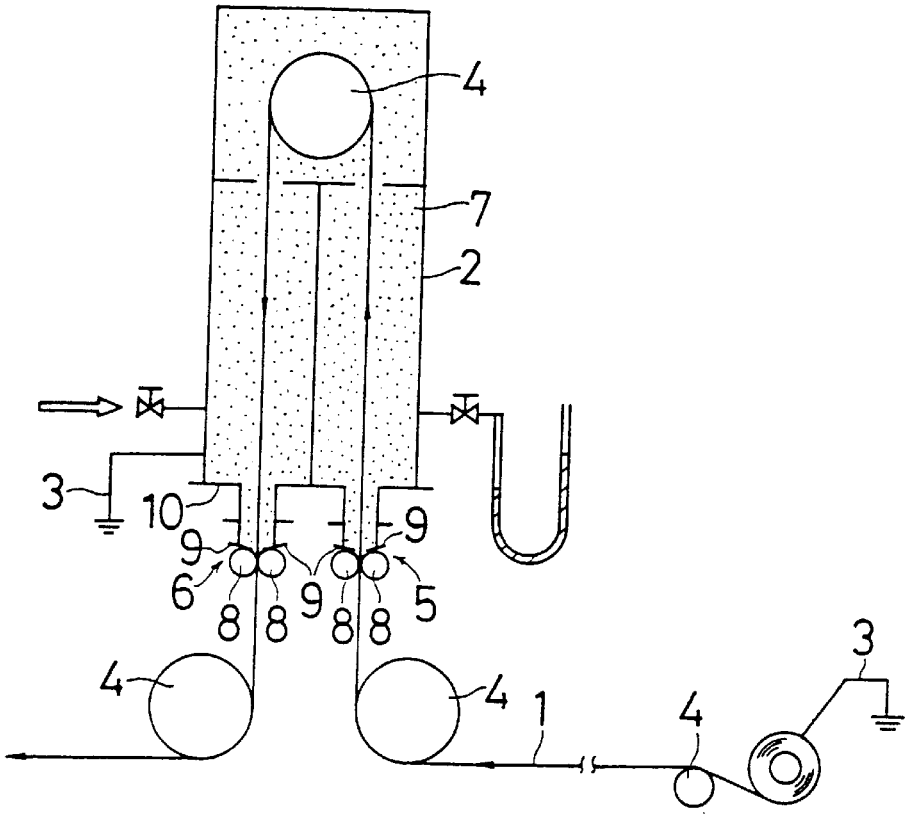
FIG. 12 is a schematic front view showing a basic structure of an atmosphere heat treatment furnace.
Figure 13:
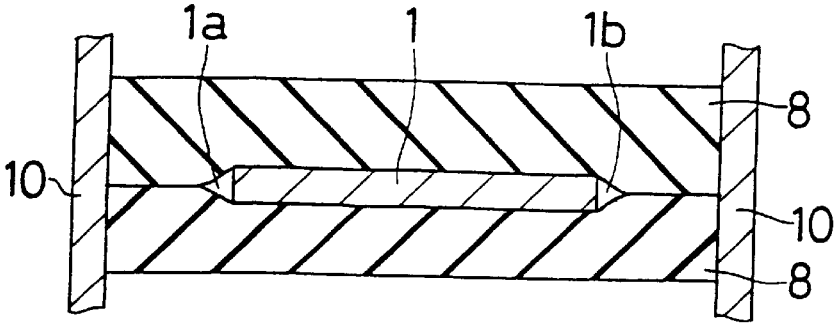
FIG. 13 is a schematic sectional explanatory view showing the positions of elastic rolls of a prior art arrangement in such a state that a metal strip or the like is held between the elastic rolls.
Figure 14:
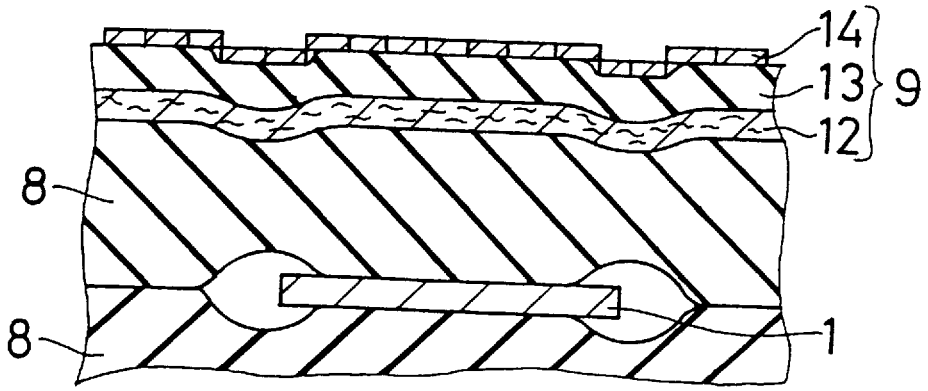
FIG. 14 is a partial sectional explanatory view showing a seal plate, and elastic rolls holding a metal strip of another prior art arrangement.
Figure 15:
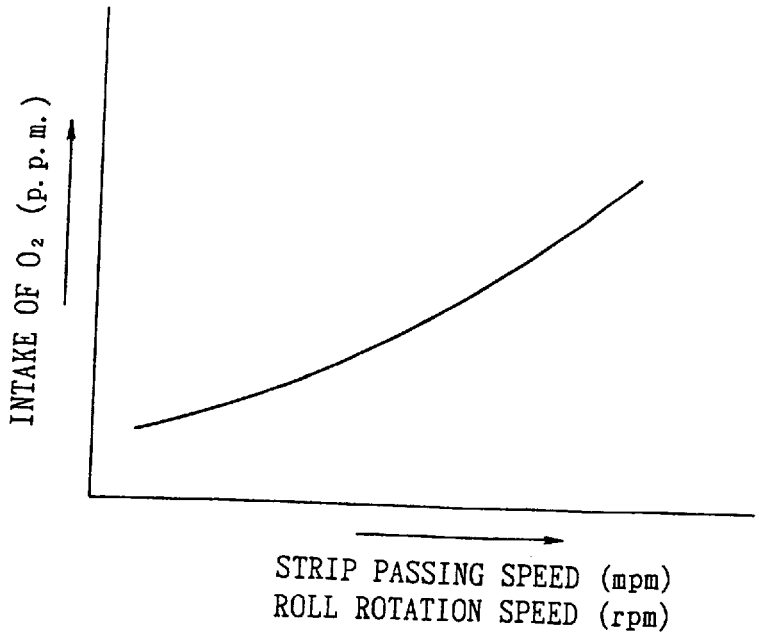
FIG. 15 is a graph showing a problem encountered in the prior art.

FIG. 11 shows a structure of the fifth embodiment of the invention. The same reference numerals designate the same parts corresponding to the first embodiment shown in FIG. 2 and the fourth embodiment shown in FIG. 10. The basic structure of the fifth embodiment shown in FIG. 11 is obtained by interchanging the roll-side parts with the anti-roll-side parts of the fourth embodiment shown in FIG. 10.

Although the inner bearings 38 (not shown) may be used, as shown in FIG. 11, the third sleeve 45 may be mounted directly on the shaft 31. A fitting portion 38*a* is formed at positions corresponding to the positions of the inner bearings 38 in accordance with the first embodiment shown in FIG. 2 or the fourth embodiment shown in FIG. 10 by machining the third sleeve 45. With this structure, the inner bearings 38 can be omitted, thereby reducing parts count, ensuring economy and simplifying assembly. The functions of the parts are not described here since they are identical to those used for the fourth embodiment.

Industrial Utility

As described above, according to the present invention, the pair of elastic rolls and the pair of additional elastic rolls are used to hold the strip so as to enhance the sealing performance of the sealing apparatus of the invention, thereby attaining reliable sealing.

According to the invention, even when the atmosphere gas is a combustible gas including hydrogen gas, the danger of causing explosions and fires can be prevented by securely shutting off the outside air, thereby ensuring safety of operation.

Furthermore, according to the invention, since the atmosphere gas of an atmosphere heat treatment furnace or a gas similar to the atmosphere is supplied to the space formed by being surrounded by the rolls, this method has a cleaning effect as if the surfaces of the metal strip or the like are cleaned preliminary with the atmosphere gas in the furnace or a gas similar to the atmosphere. Therefore, outside air attached to the surfaces of the metal strip and harmful to the quality of the metal strip can be eliminated, and the outside air can be prevented from entering the atmosphere heat treatment furnace. Since the atmospheric gas of the atmosphere heat treatment furnace or a gas similar to the atmosphere is supplied to the space surrounded by the rolls, even if the gas enters the atmosphere heat treatment furnace, the operation conditions of the atmosphere heat treatment furnace are not disturbed, thereby attaining stable heat treatment. Consequently, products having superior surface quality can be produced and yields can be enhanced, thereby reducing production cost.

Furthermore, according to the invention, an inert gas or a gas similar to the inert gas is supplied to space surrounded by the rolls. This method also has a cleaning effect as described above as if the surfaces of the metal strip or the like are cleaned preliminarily to eliminate outside air attached to the surfaces of the metal strip or the like and harmful to the quality of the metal strip or the like, thereby preventing the outside air from entering the atmosphere heat treatment furnace. Even when an inert gas or a gas similar to the inert gas is supplied into the atmosphere heat treatment furnace, the heat treatment conditions of the furnace are not changed significantly. Even when the atmosphere gas is expensive, preliminary cleaning can be performed by using an inexpensive inert gas or the like to the extent that the heating conditions are not affected, thereby continuing stable heat treatment at low cost. Consequently, production cost can be reduced.

Furthermore, according to the invention, the atmosphere gas supplied from a supplying device or a gas similar to the atmosphere, or an inert gas or a gas similar to the inert gas can include ions generated by the ion generator. Therefore, even when an electrostatic charge occurs at the elastic materials of the rolls and the seal plate, the generated static electricity is neutralized, thereby preventing fires from being caused by sparking or the like in the vicinity of the sealing apparatus and preventing deterioration due to dents or scratches caused when fine particles, which are apt to attach to substances when charged electrostatically, attach to the rolls. Consequently, products having superior surface quality can be produced reliably. In addition, since shutdown of operation due to fires or the like is prevented, productivity can be enhanced.

Furthermore, according to the invention, since the tightness of the inlet and outlet is enhanced, the interior of the atmosphere heat treatment furnace can easily be maintained under vacuum or reduced pressure. Therefore, power energy for pressure reduction can be decreased.

Furthermore, according to the invention, the space surrounded by the rolls and disposed between the atmosphere heat treatment furnace and the outside air is subjected to vacuum suction. Therefore, the outside air having entered the space surrounded by the rolls can be eliminated and prevented from entering the atmosphere heat treatment furnace. In particular, when the atmospheric pressure is a vacuum, the vacuum in the atmosphere heat treatment furnace is maintained, thereby performing stable vacuum heat treatment. Consequently, products superior in quality can be obtained.

Furthermore, according to the invention, since multi-stage sealing can be attained along the metal strip without causing frictional wear on the surfaces of the metal strip, more reliable hermetic sealing and preliminary cleaning of the surfaces of the metal strip for eliminating the outside air attached to the surfaces of the metal strip can be carried out in several stages without the fear of causing scratches. Therefore, the atmosphere gas in the atmosphere heat treatment furnace, even when supplied in small volumes, can be maintained in high quality. When a stainless steel strip is treated in a bright annealing furnace, for example, high-quality products free from coloration due to oxidation and free from scratches can be produced by high speed passing of the strip.

Furthermore, according to the invention, since sealing can be attained securely at the end surfaces of the elastic roll, the performance of sealing the inlet and outlet of the atmosphere heat treatment furnace can be enhanced further. In addition, since the rotation load is reduced by the bearings, even when the elastic rolls are provided in multiple stages, the amount of energy required for rotating the elastic rolls is small. Therefore, even when a motor or the like is used as an energizing device to attain high speed rotation, a small motor can be used. Since the motor is small, the inertia force $GD^2$ of the motor is small. Therefore, highly responsive controllability can be obtained, and the load and tension required for the passing of the strip can be prevented from increasing and changing. As a result, the form of the metal strip can be maintained.

As seen from the above, the sealing apparatus of the invention can be used for a variety of facilities. The apparatus is useful in not only enhancing the surface quality of products but also in significantly reducing the amount of a gas used for maintaining the atmosphere, electric power for reducing pressure, consumption of electric power and the like used for driving the elastic rolls, because of the enhanced sealing effect of the apparatus. Furthermore, since these advantages can be attained safely, the industrial economic effects of the invention are outstanding.

What is claimed is:

1. A sealing apparatus for hermetically sealing the inlet and/or outlet of an atmosphere heat treatment furnace while holding a strip between a pair of elastic rolls, said apparatus comprising:

a pair of additional elastic rolls for holding the strip outside said atmosphere heat treatment furnace and spaced from said pair of elastic rolls;

a pair of intermediate rolls disposed between said pair of elastic rolls and said pair of additional elastic rolls;

said pair of intermediate rolls contacting said pair of elastic rolls and said pair of additional elastic rolls over full lengths thereof in an axial direction thereof; and a space surrounded by all said rolls being formed under a condition that the strip is held between said pair of elastic rolls and said pair of additional elastic rolls.

2. The sealing apparatus for the inlet and/or outlet of an atmosphere heat treatment furnace of claim 11, wherein said atmosphere heat treatment furnace is filled with an atmospheric combustible gas including hydrogen gas retained under a pressure slightly higher than atmospheric pressure.

3. The sealing apparatus for the inlet and/or outlet of an atmosphere heat treatment furnace of claim 2, further comprising supply means for supplying the atmosphere gas for said atmosphere heat treatment furnace or a gas similar to the atmosphere gas to a space surrounded by all said rolls.

4. The sealing apparatus for the inlet and/or outlet of an atmosphere heat treatment furnace of claim 3, wherein said supply means is provided with an ion generator.

5. The sealing apparatus for the inlet and/or outlet of an atmosphere heat treatment furnace of claim 2, further comprising supply means for supplying an inert gas or a gas similar to an inert gas to a space surrounded by all said rolls.

6. The sealing apparatus for the inlet and/or outlet of an atmosphere heat treatment furnace of claim 5, wherein said supply means is provided with an ion generator.

7. The sealing apparatus for the inlet and/or outlet of an atmosphere heat treatment furnace of claim 1, further comprising supply means for supplying the atmosphere gas for said atmosphere heat treatment furnace or a gas similar to the atmosphere gas to a space surrounded by all said rolls.

8. The sealing apparatus for the inlet and/or outlet of an atmosphere heat treatment furnace of claim 7, wherein said supply means is provided with an ion generator.

9. The sealing apparatus for the inlet and/or outlet of an atmosphere heat treatment furnace of claim 1, further comprising supply means for supplying an inert gas or a gas similar to an inert gas to a space surrounded by all said rolls.

10. The sealing apparatus for the inlet and/or outlet of an atmosphere heat treatment furnace of claim 9, wherein said supply means is provided with an ion generator.

11. The sealing apparatus for the inlet and/or outlet of an atmosphere heat treatment furnace of claim 1, comprising plural pairs of said intermediate rolls and plural pairs of said additional elastic rolls along the strip, and a plurality of spaces surrounded by all said rolls.

12. The sealing apparatus for the inlet and/or outlet of an atmosphere heat treatment furnace of claim 1, further comprising:

a side wall for sealing by contacting with respective end surfaces of said rolls;

a seal plate for sealing a boundary between a casing and said pair of elastic rolls disposed most adjacent to said atmosphere heat treatment furnace by elastically contacting with outer peripheral surfaces of said pair of elastic rolls;

covering members formed of an elastic material and comprising a first flange contacting said end surfaces of said rolls and a first sleeve extending outwardly from an outer peripheral surface of said first flange in an axial direction of said rolls, said covering members being incorporated as members of a roll end seal apparatus and disposed at opposite ends of each roll;

first supporting members disposed at opposite ends of each roll and formed of a rigid material, each first supporting member comprising a second flange which makes a junction with an outer surface of said first flange, and a second sleeve extending outwardly from an outer peripheral surface of said second flange in said axial direction of said rolls;

second supporting members disposed at opposite ends of each roll and formed of a rigid material, each second supporting member comprising a third sleeve arranged between a shaft of each roll and said second sleeve outwardly from said second flange in said axial direction of said rolls and a third flange extending from an outer end surface of said third sleeve in said axial direction of said roll to a radial direction of said rolls;

outer bearings each interposed between said third sleeve and said second sleeve to receive radial and thrust forces, said outer bearings being disposed at opposite ends of each roll;

inner bearings each interposed between said third sleeve and said shaft of each roll; and an end surface sealing member interposed between a side wall of said casing and said third flange of said second supporting member at opposite ends of each roll, at least an outward side of which in the radial direction of said roll is formed of an elastic material.

13. The sealing apparatus for the inlet and/or outlet of an atmosphere heat treatment furnace of claim 12, further comprising means for injecting an inert gas or a gas similar to the atmosphere gas in said furnace into spaces formed inwardly from portions where said third flanges of said second supporting members, connected to said side wall surface via said end surface sealing member, slidingly contact said outer covering members rotating together with said rolls during rotation there, via gas passages provided in said shafts of said rolls.

14. The sealing apparatus for the inlet and/or outlet of an atmosphere heat treatment furnace of claim 12, further comprising means for generating vacuum in spaces formed inwardly from portions where said third flanges of said second supporting members, connected to said side wall surface via said end surface sealing member, slidingly contact said covering members rotating together with said rolls during rotation, via gas passages provided in said shafts of said rolls.

15. A sealing apparatus for hermetically sealing the inlet and/or outlet of an atmosphere heat treatment furnace while holding a strip between a pair of elastic rolls, said apparatus comprising:

a pair of additional elastic rolls for holding the strip outside said atmosphere heat treatment furnace and spaced from said pair of elastic rolls;

a pair of intermediate rolls disposed between said pair of elastic rolls and said pair of additional elastic rolls;

said pair of intermediate rolls contacting said pair of elastic rolls and said pair of additional elastic rolls over full lengths thereof in an axial direction thereof; and a space surrounded by all said rolls being formed under a condition that the strip is held between said pair of elastic rolls and said pair of additional elastic rolls, and an interior of said atmosphere heat treatment furnace is maintained under a pressure lower than atmospheric pressure.

16. The sealing apparatus for the inlet and/or outlet of an atmosphere heat treatment furnace of claim 15, further comprising suction means for generating a vacuum in said space surrounded by all said rolls.

17. The sealing apparatus for the inlet and/or outlet of an atmosphere heat treatment furnace of claim 16, comprising plural pairs of intermediate rolls and plural pairs of additional elastic rolls provided along the strip, and a plurality of spaces surrounded by all said rolls.

18. The sealing apparatus for the inlet and/or outlet of an atmosphere heat treatment furnace of claim 15, comprising plural pairs of intermediate rolls and plural pairs of additional elastic rolls provided along the strip, and a plurality of spaces surrounded by all said rolls.

19. The sealing apparatus for the inlet and/or outlet of an atmosphere heat treatment furnace of claim 15, further comprising:

a side wall for sealing by contacting with respective end surfaces of said rolls;

a seal plate for sealing a boundary between a casing and said pair of elastic rolls disposed most adjacent to said atmosphere heat treatment furnace by elastically contacting with outer peripheral surfaces of said pair of elastic rolls;

covering members formed of an elastic material and comprising a first flange contacting said end surfaces of said rolls and a first sleeve extending outwardly from an outer peripheral surface of said first flange in an axial direction of said rolls, said covering members being incorporated as members of a roll end seal apparatus and disposed at opposite ends of each roll;

first supporting members disposed at opposite ends of each roll and formed of a rigid material, each first supporting member comprising a second flange which makes a junction with an outer surface of said first flange, and a second sleeve extending outwardly from an outer peripheral surface of said second flange in said axial direction of said rolls;

second supporting members disposed at opposite ends of each roll and formed of a rigid material, each second supporting member comprising a third sleeve arranged between a shaft of each roll and said second sleeve outwardly from said second flange in said axial direction of said rolls and a third flange extending from an outer end surface of said third sleeve in said axial direction of said roll to a radial direction of said rolls;

outer bearings each interposed between said third sleeve and said second sleeve to receive radial and thrust forces, said outer bearings being disposed at opposite ends of each roll;

inner bearings each interposed between said third sleeve and said shaft of each roll; and an end surface sealing member interposed between a side wall of said casing and said third flange of said second supporting member at opposite ends of each roll, at least an outward side of which in the radial direction of said roll is formed of an elastic material.

20. The sealing apparatus for the inlet and/or outlet of an atmosphere heat treatment furnace of claim 19, further comprising means for injecting an inert gas or a gas similar to the atmosphere gas in said furnace into spaces formed inwardly from portions where said third flanges of said second supporting members, connected to said side wall surface via said end surface sealing member, slidingly contact said outer covering members rotating together with said rolls during rotation there, via gas passages provided in said shafts of said rolls.

21. The sealing apparatus for the inlet and/or outlet of an atmosphere heat treatment furnace of claim 19, further comprising means for generating vacuum in spaces formed inwardly from portions where said third flanges of said second supporting members, connected to said side wall surface via said end surface sealing member, slidingly contact said covering members rotating together with said rolls during rotation, via gas passages provided in said shafts of said rolls.

* * * * *